United States Patent [19]

Birx et al.

[11] Patent Number: 4,730,166

[45] Date of Patent: Mar. 8, 1988

[54] ELECTRON BEAM ACCELERATOR WITH MAGNETIC PULSE COMPRESSION AND ACCELERATOR SWITCHING

[75] Inventors: Daniel L. Birx, Brentwood; Louis L. Reginato, Orinda, both of Calif.

[73] Assignee: The United States of America as represented by the United States Department of Energy, Washington, D.C.

[21] Appl. No.: 867,126

[22] Filed: May 27, 1986

Related U.S. Application Data

[63] Continuation-in-part of Ser. No. 592,302, Mar. 22, 1984, Pat. No. 4,646,027.

[51] Int. Cl.[4] ..... H05H 5/08

[52] U.S. Cl. ..... 328/233

[58] Field of Search ..... 320/233, 59, 67; 250/396, 396 ML; 363/59; 307/110

[56] References Cited

U.S. PATENT DOCUMENTS 4,274,134 6/1981 Johannessen ..... 363/59
4,275,317 6/1981 Laudenslager et al. ..... 307/415

OTHER PUBLICATIONS

"The Application of Magnetic Switches as Pulse Sources for Inductor Linacs", Birx et al, Mar. '83, Laurence Livermore Laboratory, preprint.
"Magnetic Switching", Birx et al, 6/1983, Lawrence Livermore Laboratory, preprint.
Energy and Technology Review, 8/1983, p. 11, Birx.
"Magnetic Pulse Modulators", Busch et al., pp. 943-993, *Bell System Technical Journal*, Sep. 1955.
*Energy and Technology Review*, 12/1981, p. 1, "Generating Intense Electron Beams for Military Applications".
*An Investigation into the Repetition Rate Limitations of Magnetic Switches", Birx et al, Feb. 1982, Lawrence Livermore Laboratory preprint.*
"Regulation and Drive System for High Rep Rate Magnetic Pulse Compressors", Birx et al, May 1982, Lawrence Livermore Laboratory preprint.
"The Application of Magnetic Pulse Compression to the Grid System of the EIA/ATA Accelerator", Birx et al, 1982, Lawrence Livermore Laboratory.
The Proceedings of the Institution of Electrical Engineers, Part, III, No. 53, May 1951, vol. 98, p. 185, "*The Use of Saturable Reactors as Discharge Devices for Pulse Generators*", by W. S. Melville.
"Pulse Generators", Glascoe et al, 1948, pp. 470-477, McGraw Hill, "Experimental Test Accelerator", Hestor et al, Mar. 1979, Lawrence Livermore Laboratory preprint.
"Basic Principles Governing the Design of Magnetic Switches", Birx et al, Nov. 1980, Lawrence Livermore Laboratory report.
"High Voltage, Magnetically Switches Pulsed Power System", Van Devender et al, pp. 256-261, presented at 1981 Pulsed Power Conference.
"Experiments in Magnetic Switching" by Birx et al, pp. 262-268, present at 1981 Pulsed Power Conference.
"Economic Design of Saturating Reactor Magnetic Pulsers", Mathias et al, pp. 169-171; AIEE Winter General Meeting, 5/1955.
"Coil Pulsers for Radar" by Peterson, pp. 603-615, *Bell Technical Journal* (1946?).

*Primary Examiner*—David K. Moore
*Assistant Examiner*—Sandra L. O'Shea
*Attorney, Agent, or Firm*—Michael B. K. Lee; Clifton F. Clouse, Jr.; Judson R. Hightower

[57] ABSTRACT

An electron beam accelerator comprising an electron beam generator-injector to produce a focused beam of ≧0.1 MeV energy electrons; a plurality of substantially identical, aligned accelerator modules to sequentially receive and increase the kinetic energies of the beam electrons by about 0.1-1 MeV per module. Each accelerator module includes a pulse-forming network that delivers a voltage pulse to the module of substantially ≧0.1-1 MeV maximum energy over a time duration of ≦1 μsec.

13 Claims, 13 Drawing Figures

ELECTRON BEAM ACCELERATOR WITH MAGNETIC PULSE COMPRESSION AND ACCELERATOR SWITCHING

The United States Government has rights in this invention pursuant to Contract No. W-7405-ENG-48 between the U.S. Department of Energy and the University of California, for the operation of the Lawrence Livermore National Laboratory.

RELATED INVENTION

This Application is a continuation-in-part of U.S. Ser. No. 06/592,302, filed 22 March 1984 now U.S. Pat. No. 4,646,027

FIELD OF THE INVENTION

This invention relates to generation and acceleration of charged particle beams to produce high energy, high current pulses of duration less than 1 μsec.

BACKGROUND OF THE INVENTION

Pulse power applications, such as production of a high energy electron beam over a time period of 1 μsec. or less, require beam accelerator modules that operate over correspondingly brief time intervals with reasonable energy efficiency, preferably 50 percent or higher. End uses for resulting charged particle beams include injection of charge particle species into a plasma confinement device, preservation of food and defense applications. One attractive approach for production of an abbreviated, high voltage pulse for the accelerator module(s) uses a little-known technique of nonlinear or saturable inductors in an appropriate capacitive-inductive ladder network first discussed by W. S. Melville in *Proceedings of the Institution of Electrical Engineers,* Vol. 98, Part III pp. 185–208 (May 1951). The method examined by Melville yields foreshortened pulses but may not improve the ratio of pulse rise time or pulse fall time to the time period of pulse plateau, which ratio should be as small as possible to produce pulses reasonably close to square waves in shape.

SUMMARY OF THE INVENTION

One object of this invention is to provide electron acceleration apparatus to accelerate electrons to high energy and high current density in pulses of ≧1 μsec. duration (FWHM).

Another object is to provide electron acceleration apparatus with controllable repetition rates up to about 30 kilohertz.

Another object is to provide a pulse forming network to produce one or a sequence of voltage pulses with controllably short pulse rise time and pulse fall time of no more than 20 nanoseconds and to deliver the pulse(s) to an electrical load.

Other objects of the invention, and advantages thereof, will become clear by reference to the detailed description and accompanying drawings.

To achieve the foregoing objects, the invention in one embodiment may comprise: initial energy storage means, having an output terminal, to produce a voltage pulse of time duration substantially one microsecond or greater and voltage ≧10 kV at the storage means output terminal; and a magnetic compression network, with an input terminal and an output terminal, coupled to the output terminal of the initial energy storage means, for receiving at its input terminal the one microsecond or greater voltage pulse from the initial energy storage means and for producing at its output terminal a pulse of voltage ≧100 kV of duration ≧20 nanoseconds with ≧5 nanosecond rise time and fall time, the network comprising: a grounded capacitor connected at one end to the output terminal of the initial energy storage means; a first saturable inductor having two ends with inductances satisfying $L^{(unsat.)}/L^{(sat.)} \geqq 100$, connected to the initial energy storage means output terminal at the first end of the first inductor; a first water-filled pulse transmission line having two ends and having impedance of substantially ≧0.1 ohms, connected at one end to the second end of the first saturable inductor; a second saturable inductor having two ends and having inductances satisfying $L^{(unsat.)}/L^{(sat.)} \geqq 100$, connected at one end to the second end of the first water-filled pulse transmission line; a second water-filled pulse transmission line having two ends, of impedance substantially ≧0.1 ohms, connected at one end to the second end of the second saturable inductor; a voltage step-up transformer, having input and output terminals, coupled at its input terminal to the second end of the second pulse transmission line; and a third saturable inductor having two ends and having inductances satisfying $L^{(unsat.)}/L^{(sat.)} \geqq 100$, connected at one end to the output terminal of the voltage transformer and connected at its second end to a load to which the output pulse is to be delivered.

In a second embodiment, the invention may comprise: a voltage pulse source having an output terminal, for producing a sequence of pulses of current ≧20 kamps, voltage ≧20 kV and pulse duration substantially one μsec or greater; a first capacitor with one grounded terminal and a second terminal connected (directly or indirectly) to the output terminal of the voltage pulse source; a first nonlinear inductor, with one terminal thereof connected to the second terminal of the first capacitor; a pulse transmission line with associated impedance of substantially two ohms, with one terminal thereof connected to a second terminal of the first nonlinear inductor; a second nonlinear inductor with a first terminal thereof connected to a second terminal of the pulse transmission line and a second terminal thereof connected to a predetermined electrical load for the pulse-forming network; and a grounded, electrically conducting tube substantially surrounding the electrical connection between the second nonlinear inductor and the electrical load.

In a third embodiment, the invention may comprise: a voltage pulse source with an output terminal, for producing a sequence of pulses of current ≧20 kamps, voltage ≧20 kV and pulse duration substantially one μsec or greater; a first capacitor with one grounded terminal and a second terminal connected (directly or indirectly) to the output terminal of the voltage pulse source; a first nonlinear inductor with one terminal thereof connected to the second terminal of the first capacitor; a second capacitor with one grounded terminal and a second terminal thereof connected to a second terminal of the first nonlinear inductor; a second nonlinear inductor with one terminal thereof connected to the second terminal of the second capacitor; a pulse transmission line with associated impedance of substantially two ohms, with one terminal thereof connected to a second terminal of the second nonlinear inductor; a third nonlinear inductor with one terminal thereof connected to a second terminal of the pulse transmission line and a second terminal thereof electrically connected to the electrical load; and a grounded, electrically conducting tube substantially surrounding the electrical connection between the third nonlinear inductor and the load.

The present invention produces a pulse shortening by a factor of the order of 20 or more and squares the pulse. This is useful, for example, in accelerators for electron beams having a time duration of substantially one μsec. or less.

DETAILED DESCRIPTION

The apparatus described here, called simply an improved ATA, is the latest in a series of charged particle induction accelerators developed by the Lawrence Livermore National Laboratory (LLNL) and the Lawrence Berkeley National Laboratory (LBNL). The resulting charged particle beams have utility for injecting energetic charged particles into plasma confinement apparatus, for food preservation and for defense applications. Table I compares five of the most important parameters of five of these accelerators, including the ATA and the new ARC, which is based upon this new technology and is located at LLNL. As compared to the earliest of these accelerators, the Astron II, the ATA has achieved an eight-fold increase in beam energy, a twelve-fold increase in current, a six-fold decrease in the time duration of the pulse produced and a modest increase in burst (repetition) rate in about 15 years of development; the improved ATA carries this further, allowing burst rates of up to 30 kHz. and other improvements. Table II compares parameters of previous spark gap technology, ATA magnetic compression operating points, and operating ranges for use with the invention.

TABLE I

Comparison of original ATA with earlier induction accelerators.

| | Astron II | ERA | ETA | ATA | ARC |
|---|---|---|---|---|---|
| Beam energy, MeV | 6 | 4 | 4.5 | 50 | 4 |

TABLE I-continued

Comparison of original ATA with earlier induction accelerators.

| | Astron II | ERA | ETA | ATA | ARC |
|---|---|---|---|---|---|
| Current, kamp | 0.8 | 1.2 | 10 | 10 | 3 |
| Pulse length, nsec | 300 | 30 | 40 | 70 | 50 |
| Burst rate, Hz | 800 | 2 | 1000 | 1000 | 10,000 |
| Average rate, Hz | 5 | 2 | 5 | 5 | 1000 |

TABLE II

| Parameter | Previous Spark Gap Technology | ATA Magnetic Compression | Invention Technology Ranges |
|---|---|---|---|
| Peak output power, GW | 5 | 10 | 1 to 1000 |
| Pulse rise time (10%-90%) per cell, nsec | 18 | 15 | 5 to 100 |
| Pulse length (FwHM), nsec | 70 | 80 | 10 to 10,000 |
| Pulse energy Joules | 350 | 800 | 1 to 100,000 |
| Efficiency (including resonant transformer), percent | 70 | 80 | 50 to less than 100 |
| Voltage (2-cell driver) at 18 kA/cell, kV | 100 | 300 | Arbitrary with number of accelerator modules driven |
| Voltage (1-cell driver) at 25 kA/cell, kV | 200 | 450 | Arbitrary with number of accelerator modules driven |
| Pulse-to-pulse jitter at up to 1 kHz, nsec | ±1 | ±0.5 | ±0.5 |
| Peak burst rate (5 pulses), kHz | 1 | 10 | 1 pulse per second to 100 MHz |
| Peak average-repetition rate at 10% duty factor, kHz | 0.1 | 1 | 0.1 to 25 |

Figure 1:
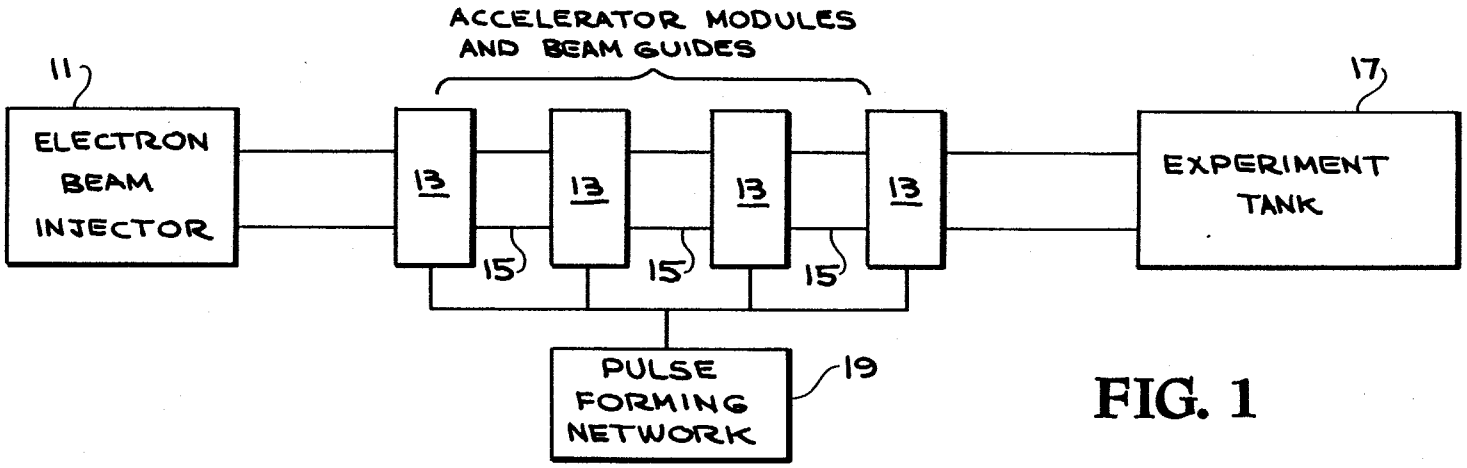
FIG. 1 is a schematic diagram of the major components of one embodiment of the invention.

With reference to the schematic diagram in FIG. 1, the improved ATA facility consists of four or five major components: an electron beam injector 11 to generate a focused beam of electrons of substantially ≧0.1 MeV energy each; a plurality of substantially identical, aligned accelerator modules, 13, to sequentially receive and increase the kinetic energies of the beam electrons by about 0.1-1.0 MeV per module; a plurality of static magnetic field sources, 15, one inside the accelerator module and one between each two consecutive accelerator modules to guide the electron beam from one module to the next; an optional utilization tank, 17, to receive the energetic electron beam and perform useful functions therewith and a closed container, 18, surrounding the other components in an airtight manner to maintain an internal pressure of no more than about $10^{-4}$ Torr. Each accelerator module includes a pulse-forming network, 19, that delivers a voltage pulse of about 0.1-1.0 MeV over a time duration of substantially one μsec. or less FWHM (nominally, a ≧10 nsec plateau) to the remainder of the module in timed relationship with arrival of the beam at the module.

Figure 2:
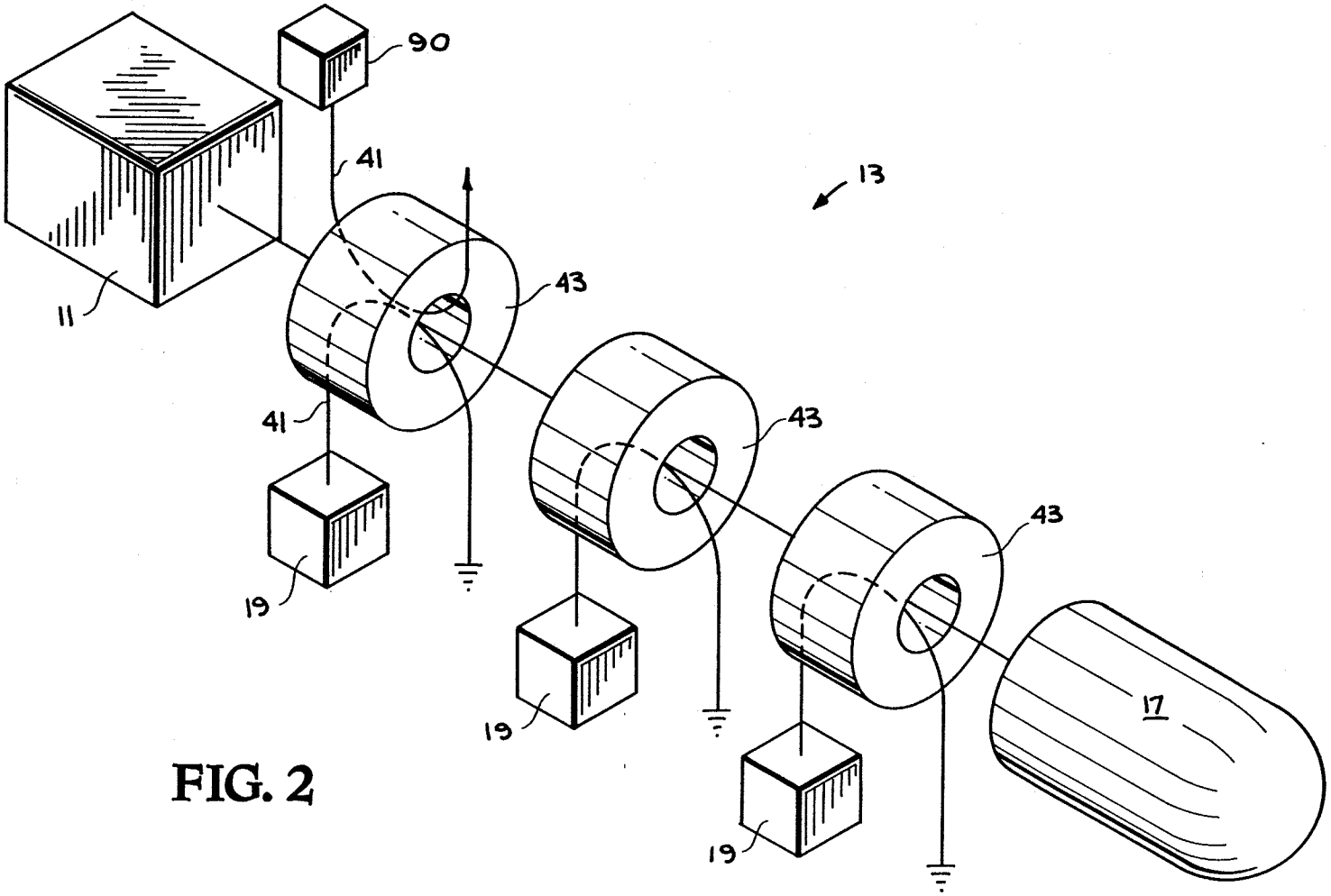
FIG. 2 is a perspective schematic view of the electron beam generator, several aligned accelerator modules and corresponding pulse-forming networks and the utilization tank.

FIG. 2 shows the relative positions of the electron beam injector 11, several of the aligned accelerator modules 13 and the utilization tank 17. One loop of a lead wire or other electrical conductor, 41, coming from a pulse-forming network, 19, winds through a ferrite core 43, as shown, to induce a rapid change in flux in the core as a result of passage of about a one μsec. or less voltage pulse along each lead wire. The single toroids can be ferrite of PEllB material, such as is supplied by TDK, or Metglas ® 2605 material supplied by Allied Corporation, any thin (less than about 0.6 mil) amorphous magnetic material, or any ferro- or ferrimagnetic material. The total flux swing from this ferrite is about 6 kilogauss (0.6 webers/$m^2$) with a coercive force of about 0.25 Oersteds. It is this rapid change in time of flux or magnetic induction, B, that produces the accelerating electric field adjacent to tne toroid for the electron beam as the electron beam passes along the toroid axis. The total flux swing of the amorphous magnetic materials can be as high as 2.5–3.0 Webers/$m^2$.

Figure 3:
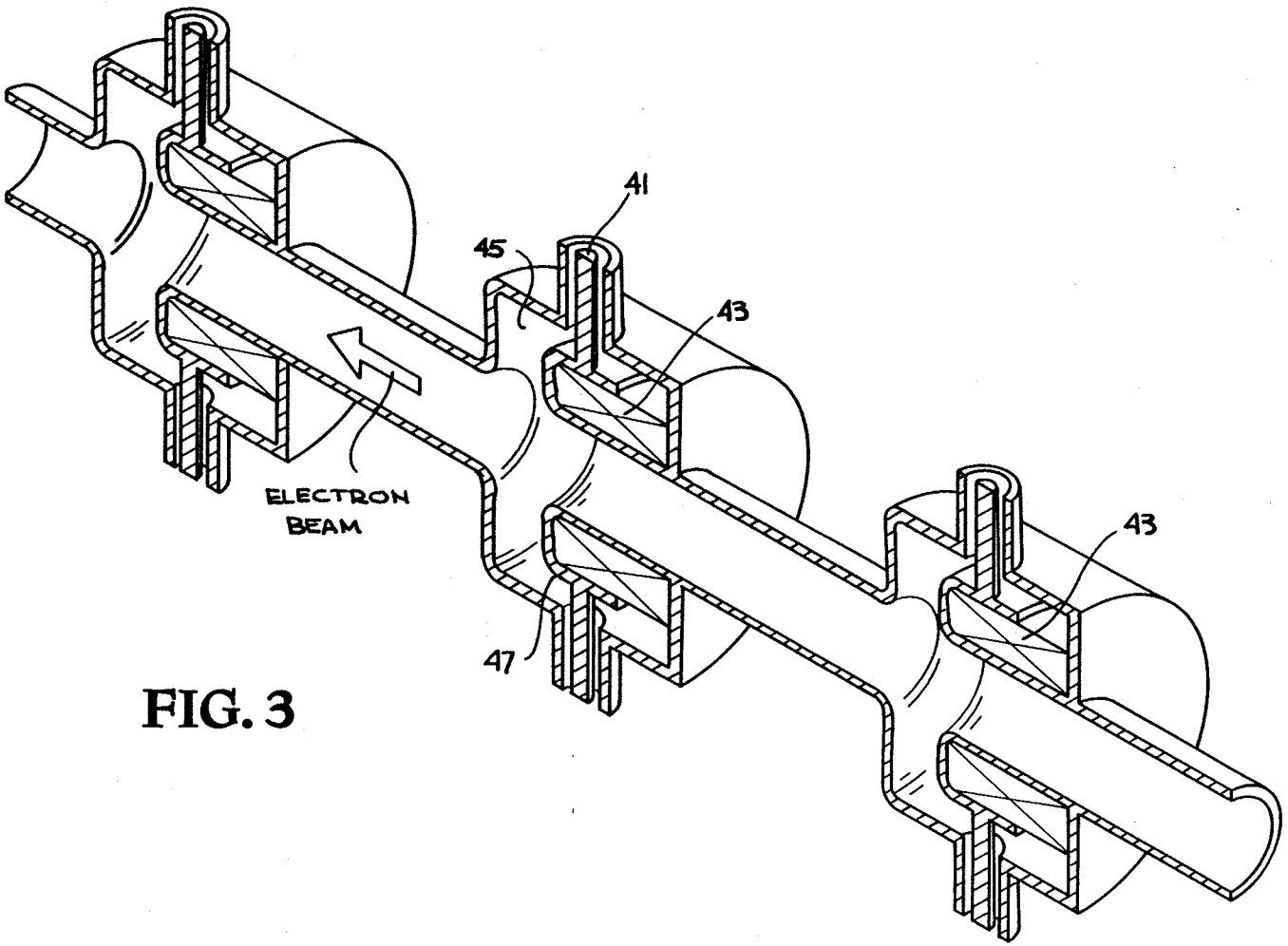
FIG. 3 is a cross-sectional view of several of the aligned accelerator modules.

FIG. 3 is a cross-sectional view of three of the accelerator modules, showing the electron beam current passing along the common central axis of the toroids, the ferrite cores 43, the accelerator gap, 45, associated with each accelerator module, the lead wire 41 for the high voltage pulse delivered symmetrically to each "half" of an accelerator module and an electrical conductor, 47, to provide the single turn around the ferrite core of each accelerator module and act as a path for return current.

Figure 4:
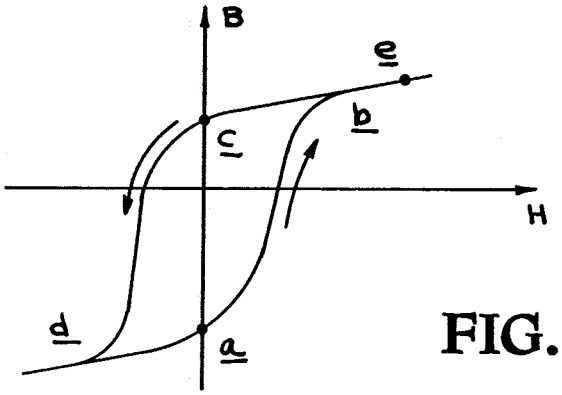
FIG. 4 is a graphic view of a representative hysteresis curve of a ferromagnetic material useful in the invention.

With reference to FIG. 4, showing schematically the development of magnetic induction, B, in a ferromagnetic material as a function of the magnetic intensity H, initially the ferrite core is at a point a on the hysteresis curve corresponding to substantially zero magnetic intensity. As the magnetic intensity is rapidly increased, the operating point of the ferrite moves to point b, approximately at the "knee" of the hysteresis curve, and to e; after the voltage pulse and corresponding current has passed, the operating point of the ferrite relaxes from e through c to d and finally back to the initial point a after the reset pulse. The points on the operating curve corresponding to initial ferrite operating point (a) and the ferrite operating point at the time of the passage of the voltage pulse (b), are chosen carefully so that the material does not move appreciably beyond the "knee" of the hysteresis curve; this provides maximum efficiency as to the flux swing and corresponding accelerating voltage pulse developed by the ferrite core.

Figure 5:
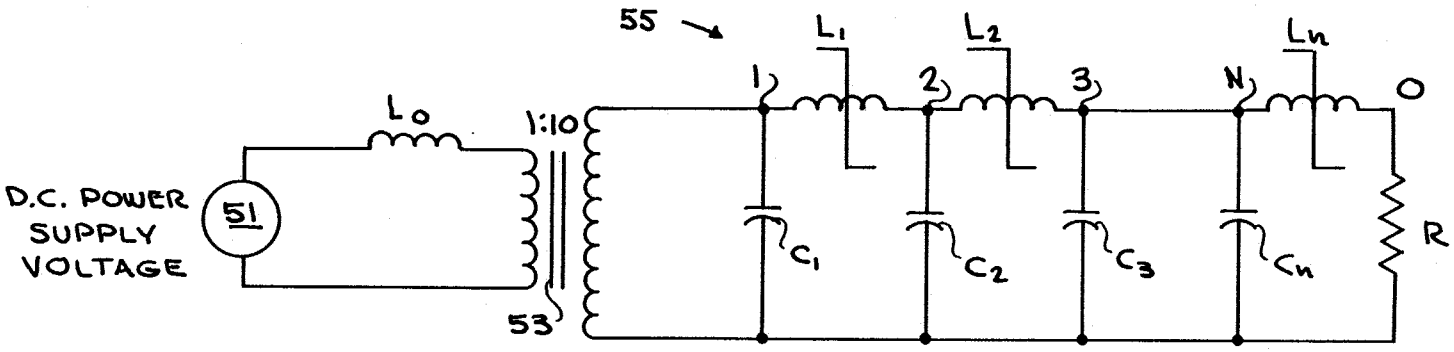
FIG. 5 is a schematic view of a capacitive-inductive ladder network useful in magnetic pulse compression in an earlier approach.

The pulse-forming network uses magnetic compression of a pulse in time (by a factor of about 150) to achieve reproducible, high efficiency (about 30–95 percent), high repetition rate voltage pulses of time duration substantially one μsec. to drive the accelerator modules. FIG. 5 shows a simple magnetic compression ladder network to produce shortened pulses, using the apparatus of Melville. One begins with a power supply, 51, coupled to a step-up voltage transformer, 53, across an initial linear inductor $L_0$ to a capacitive-inductive ladder network, 55, comprising a series of substantially identical capacitors $C_1, C_2, \ldots, C_N$ coupled by saturable inductors $L_1, L_2, \ldots, L_N$ as shown. The ladder network 55 is coupled to ground across a terminal resistor, R, and the nonlinear or saturable inductors of inductances $L_p$, satisfy the relations $L_p^{(unsat.)}/L_p^{(sat.)} \geqq f$ (p=1, 2, . . . , N) and $L_p^{(sat.)}/L_{p+1}^{(sat.)} \geqq g$ (p=1, 2, . . . ,N−1)

where f and g are predetermined numbers, each greater than or equal to 10. Preferably, f should be >400 and g should be >5. As used herein, "capacitive-inductive ladder network" means a network comprising a sequence of N(≧2) capacitors $C_1, \ldots, C_N$ arranged in parallel with each other and with a single resistor, R, at one end, all grounded at a common capacitor terminal, and a sequence of N inductors $L_1, \ldots, L_N$, with inductor $L_n$ (n=1, . . . , N−1) coupling the nongrounded terminals of capacitors $C_n$ and $C_{n+1}$ and inductor $L_N$ coupling the capacitor $C_N$ and the resistor R.

Figure 6:
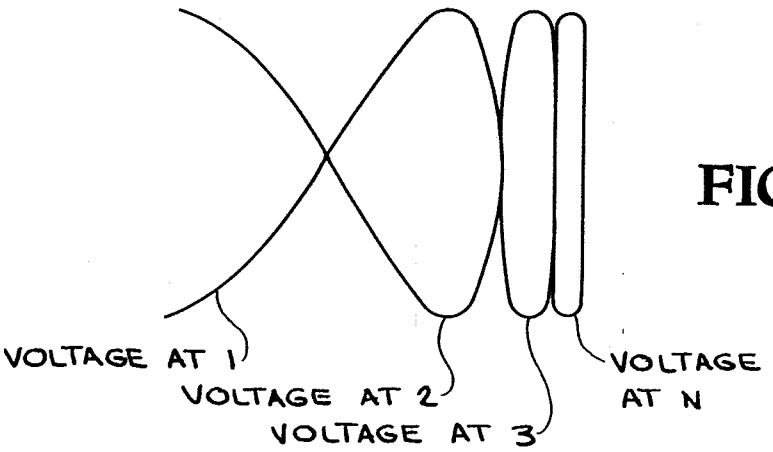
FIG. 6 is a graphic view of magnetic pulse compression at several points of the network in FIG. 5.

The ladder network 55 shown in FIG. 5 operates as follows. Capacitor $C_1$ charges through the inductor $L_0$ until the inductor $L_1$ saturates and achieves an inductance much less than that of $L_0$. when this occurs, the capacitor $C_2$ begins to charge from $C_1$ through $L_1^{(sat.)}$; but since the inductance of $L_1^{(sat.)}$ is much less than the inductance of $L_0$, $C_2$ charges much more rapidly than $C_1$ did (faster by a factor of 4 or better). This process continues through the successive stages until $C_N$ discharges into the load through the inductor $L_N^{(sat.)}$. FIG. 6 indicates the time duration of the successive voltage pulses developed at the network points 1, 2, 3, . . . , N indicated in FIG. 5. The apparatus shown in FIG. 5 is useful in explaining the principle of magnetic compression of a pulse, but the preferred embodiment of the pulse-forming network used herein is quite different (FIG. 7).

To ensure efficiency in this process, saturation at each stage occurs at the peak of the voltage waveform passing that stage. With reference to FIG. 4, segment a-b is the active or high permeability region during which the (nonlinear) inductor impedes current flow; the leveling off of the hysteresis curve at b and its continuation to e indicates that core saturation has been achieved, and the inductor achieves a very low impedance in this region. During the segment e-c-d-a, the core is reset to its original state for the next cycle.

Figure 7:
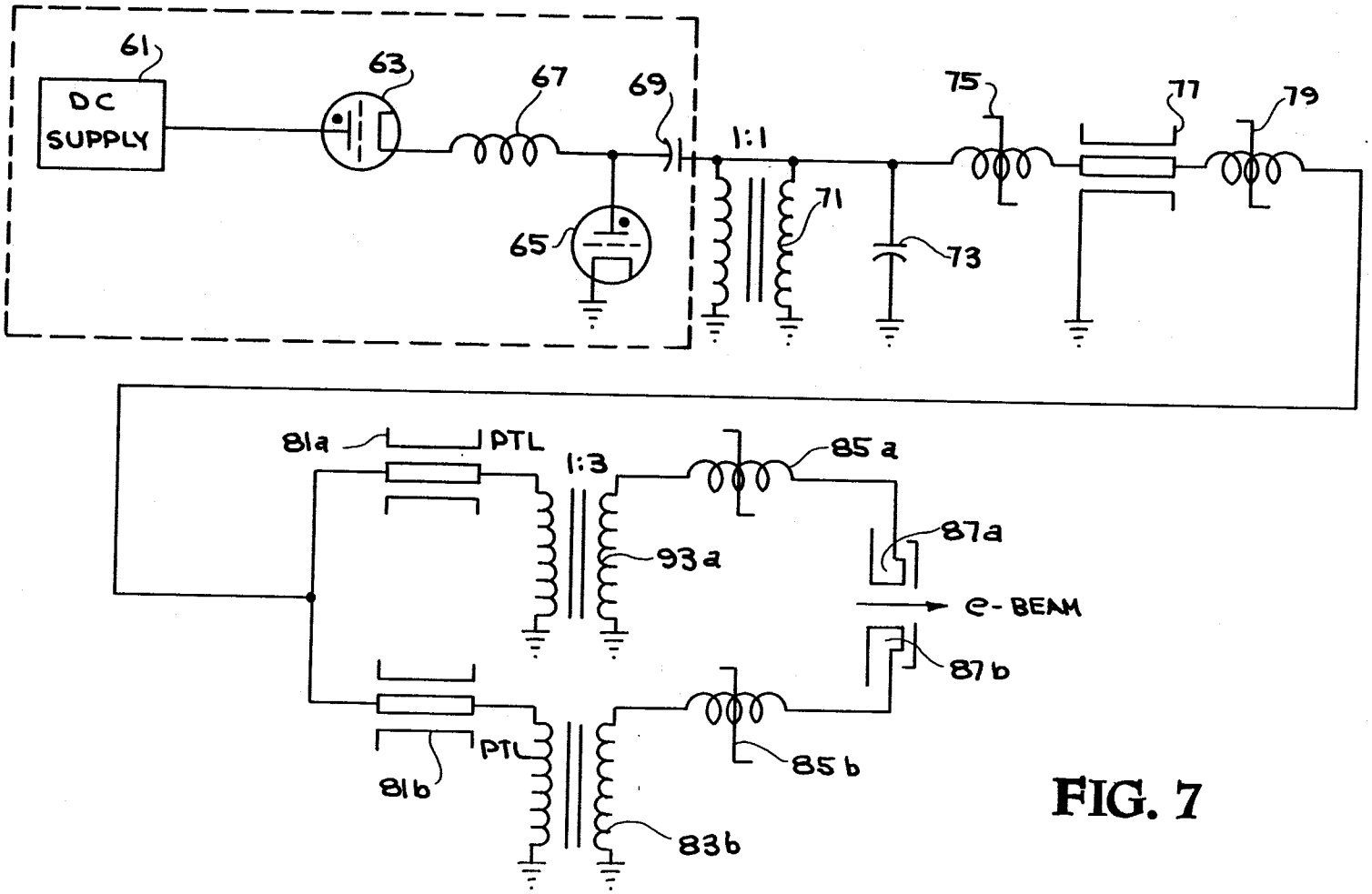
FIG. 7 is a schematic view of one embodiment of a pulse-forming network according to the invention.

FIG. 7 exhibits the pulse-forming network according to a preferred embodiment of the invention. One begins with a dc power supply with power delivery, 61, coupled to a first thyratron or other switch, 63, having a recovery time of less than 20 μsec. The first thyratron is inductively coupled to a second, similar thyratron or switch, 65, through a linear inductor, 67, having inductance L ≦$10^{-5}$ Henrys. The two thyratrons or switches and the linear inductor act as a first switch to produce a voltage pulse of approximately 28 kV of 1–5 μsec. time duration (αl-cos wt) for charging a capacitor 69. The capacitor 69 (substantially 2 μfarad) is discharged by thyratron (switch) 65 and applied to a voltage step-up transformer (1:12), 71, that steps the voltage up to approximately 336 kV. At this point, the output pulse has a time duration of about 1 μsec (αl-cos wt).

The transformer output pulse charges a capacitor, 73, with C≈14 nfarads (e.g., using a water capacitor for energy storage) and is also coupled to a nonlinear or saturable inductor, 75, that has $L^{(unsat.)} \geqq 1$ millihenry and $L^{(sat.)} \leqq 1$ μhenry. The output of the saturable inductor after saturation is a 336 kV voltage pulse of time duration Δt≈250 nsec. (FWHM), and this output moves through a 2-ohm impedance pulse transmission line (e.g., distributed energy storage in water), 77, to a second saturable inductor, 79 with $L^{(sat.)} \leqq 20$ nH and $L^{(unsat.)} \approx 20$ μH. The output of the inductor 79 after saturation is a 168 kV voltage pulse with 20 nsec. rise time and fall time (10%–90%) and 80 nsec. time duration (FWHM). This output is fed to two equal length, 4-ohm impedance, water-filled transmission lines, **81*a* and 81*b*, that are coupled, respectively, across two voltage step-up (1:3) transformers, 83*a* and 83*b*, and two saturable inductors, 85*a* and 85*b*, of $Z_o^{(sat.)}=36$ ohms and $Z_o^{(unsat.)}=720$ ohms to two sides, 87*a* and 87*b*, of the ferrite-loaded accelerator module toroid (e.g., 43 in FIG. 2). The outputs of the inductors 85*a* and 85*b*** are 500 kV voltage pulses with 10 nsec. rise time and fall time (10%–90%) and 70 nsec. time duration (FWHM) with a plateau of 0–50 nsec., or longer if desired.

One of the most critical elements of the magnetic pulse compressor is the material in the final inductor stages. The only material currently available that affords high efficiency and fast rise times is the class of new ferromagnetic metallic glasses. A metallic glass is a metal that has been liquefied and then solidified so rapidly (approximately $10^6$ degrees temperature decrease per second) that it has no time to form a crystal structure and instead forms an amorphous solid structure. This can be done by directing a thin jet of the molten metal or alloy onto a chilled, rapidly rotating metal disk or cylinder. This automatically forms a ribbon of metallic glass no more than about 28 μm thick that spins off at a very high rate. The metallic glass used in our saturable inductors or to replace our ferrite cores for the accelerator modules is either iron-based or an alloy of cobalt and iron that yields a higher saturation flux.

The metallic glass available from Allied Corporation has a saturation magnetic induction (point b on the curve in FIG. 4) of 14–18 kilogauss, depending upon the material composition, the repetition rate or frequency of cycling, and other parameters. The Metglas® Alloy 2605 SC, composed almost exclusively of iron, manifests a (static) knee induction of $B_{knee}$=13.8 kilogauss at a magnetic force of $H_{knee}$=0.4 Oersteds, and these numbers increase monotonically to $B_{knee}$=15.5 kilogauss and $H_{knee}$=0.85 Oersteds at a repetition rate of 1 kHz. The saturation magnetic induction of 2605 SC appears to be 15.7 kilogauss (as cast) or 16.1 kilogauss (annealed) and does not vary appreciably with applied frequency. This material is a general purpose, "soft" magnetic alloy. Another material of interest, Metglas® Alloy 2605 CO, an iron-cobalt compound, has higher (static) knee point ($B_{knee}$=15.5–16.5 kilogauss, $H_{knee}$=0.1–0.9 Oersteds) and higher saturation magnetic induction ($B_{sat}$=17.5 kilogauss as cast and 18.0 kilogauss annealed) and is well suited to operations above 1 kHz. Other alloys such as 2605 S-2 or S-3 offer low core loss operation at frequencies greater than 1 kHz but have lower knee and saturation field values.

For short pulses, the dominant factor in core losses is the presence of eddy currents, with the losses scaling as the square of the core material thickness and inversely with the resistivity of the core material. Amorphous metals or metallic glasses have resistivities about three times as high as the same material in its usual crystalline form and can be mass produced in ribbons of no more than about 28 μm thick. These materials are thus ideal for generating fast pulses with high efficiency as the eddy currents are quite low in such materials.

Figure 8:
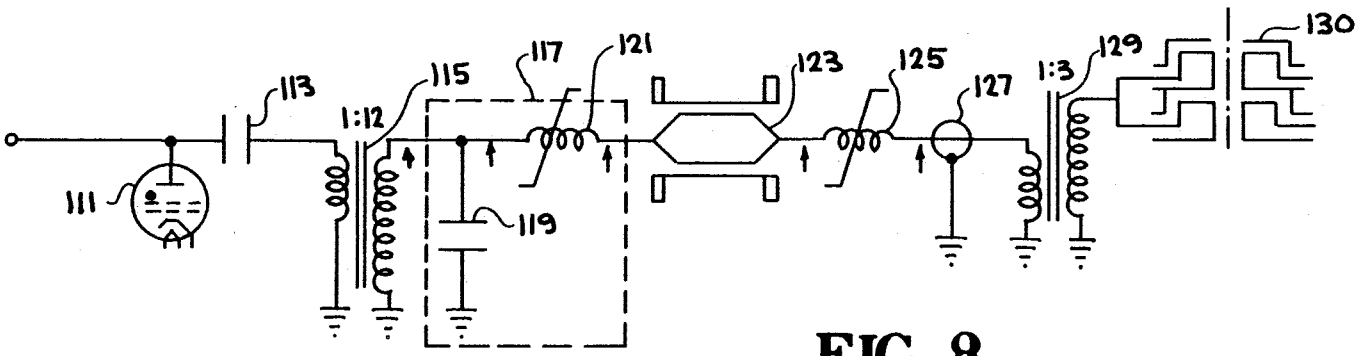
FIG. 8 is a schematic view of a second embodiment of a pulse-forming network according to the invention.

A second embodiment, shown in FIG. 8, uses only two saturable inductors and a single 2-ohm pulse transmission line, which may be water-filled, to achieve substantially the same pulse rise and fall times as those obtained for the apparatus in FIG. 7. One or more thyratrons 111 (preferably eight), each having de-ionization or recovery times $\tau_r \approx$ten μsec and average current rating of at least 15 kamps, produces one or a sequence of pulses of peak voltage substantially 25 kV and temporal duration Δt=1–5 μsec. The non-dc component of each such pulse is passed by a first capacitor 113 (C=2160 nanofarads) to a 1:12 voltage step-up transformer 115 that steps the pulse voltage up to substantially 300 kV. The output pulse from 115 then passes to an energy storage circuit 117, comprising a second capacitor 119 with one terminal grounded (C=15 nfarads) and with a second terminal connected to a first saturable inductor 121 ($L^{(unsat)}$=0.54 mhenrys, $L^{(sat)}$=0.54 μhenrys). The circuit 117 sharpens the output pulse so that rise time is substantially 200 nsec, and the output pulse is further shaped by passage through a substantially 2-ohm impedance pulse transmission line 123, preferably water-filled. The output from 123, is passed through a second saturable inductor 125 ($L^{(unsat)}$=67.5 nhenrys, $L^{(sat)}$=67.5 phenrys) and a grounded conducting tube 127 to a second transformer (voltage input:output=1:3), which delivers the voltage pulse(s) to an electrical load 130. At this point, the pulse peak voltage is substantially 450 Kv, with rise time and fall time substantially 10–20 nsec each and plateau width or FWHM determined by the electrical length of the pulse line 123. The associated current is substantially 24 kiloamps, which can be used, for example, to drive two 450 kV, 12 kamp induction cells, or a larger or smaller number of cells with correspondingly modified current through each.

Figure 9:
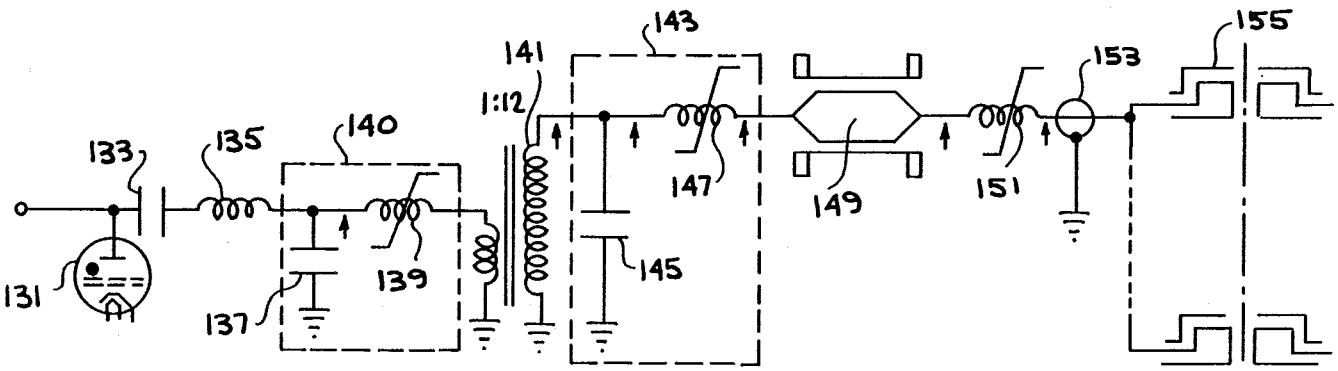
FIG. 9 is a schematic view of a third embodiment of a pulse-forming network according to the invention.
Figure 10A:
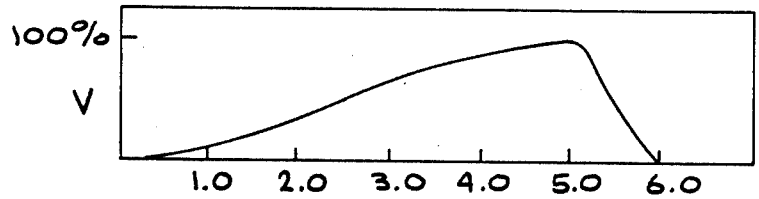
FIGS. 10 (*a,b,c,d*) are graphic views of the temporal shape developed by the voltage pulse at four specified positions in the network of FIG. 9.
Figure 10B:
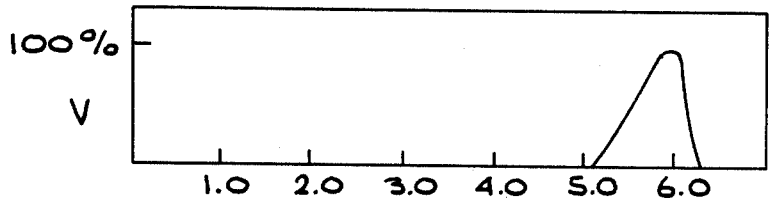
Figure 10C:
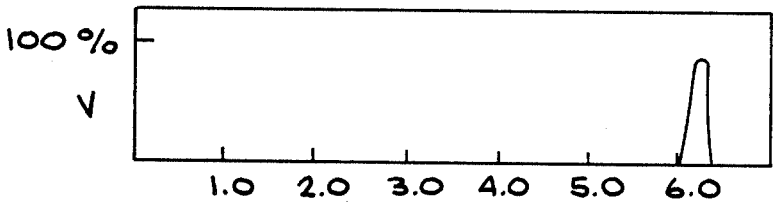
Figure 10D:
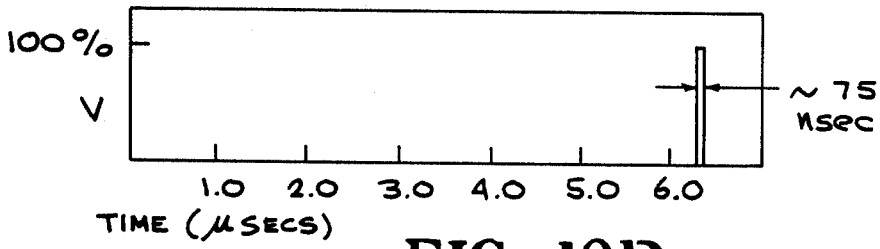

A third embodiment, shown in FIG. 9, uses three saturable inductors to obtain a similar output. One or more thyratrons 131 (preferably, eight), each having de-ionization recovery times $\tau_r \approx$ten μsec. and average current rating of at least 15 kamps, produces one or a sequence of pulses of voltage substantially 25 kV and temporal duration Δt=five μsec. The pulse(s) is passed across a first capacitor 133 (C=2160 nfarad) and an inductor 135 (L=93.8 nhenrys) operated in the conventional unsaturated range. The pulse then passes across the upper terminal of a grounded capacitor 137 (C=2160 nfarad) and across a first saturable inductor 139 ($L^{(unsat)}$=0.54 μhenrys, $L^{(sat)}$=0.54 nhenrys). The capacitor 137 and saturable inductor 139 comprise a first energy storage circuit 140 whose output passes to a 1:12 voltage step-up transformer 141 that steps the pulse voltage (now with rise time substantially 200 nsec.) up to substantially 360 kV. The pulse is now compressed by a second saturable inductor circuit 143, comprising a grounded capacitor 145 (C=15 nfarads) electrically connected to a second nonlinear or saturable inductor 147 ($L^{(unsat)}$=54 mhenrys, $L^{(sat)}$=54 μhenrys). The output pulse from 139, now having rise time of 200 nsec, charges a substantially 2-ohm impedance pulse transmission line 149, preferably water-filled. The output from the line 147 is a pulse of temporal duration Δt=75 nsec with pulse rise time of about 200 nsec. This pulse is passed through a third saturable inductor 151 ($L^{(unsat)}$=67.5 μhenrys, $L^{(sat)}$=67.5 nhenrys) and through a grounded electrically conducting tube 153 to an electrical load 155 to produce substantially 150 kV voltage and substantially 80 kamp current with a rise time of 18 nsec and duration of 75 nsec(FWHM). This configuration is suitable for driving 20 150 kV induction cells, each with substantially 4 kamp current.

FIGS. 10(*a,b,c,d*) exhibit shapes of a voltage pulse passing through the pulse shaping/compression network of FIG. 9 as measured at the second capacitor 137 (FIG. 10(*a*)), the third capacitor 145 (FIG. 10(*b*)),the pulse transmission line 149 (FIG. 10(*c*)), and the output of the third saturable inductor 151 (FIG. 10(*d*)), respectively. The initial voltage pulse has FWHM of substantially $\tau_H$=3 μsec; and as this pulse passes through the first, second and third saturable inductors the temporal duration $\tau_H$ is reduced to substantially 0.8 μsec, 300 nsec and 60 nsec, respectively, with a corresponding reduction in pulse rise time and fall time. For the pulse output after the third saturable inductor 149, the pulse rise time and fall time are each substantially ≧20 nsec; these rise and fall times can be reduced further, by use of additional saturable inductors, to times of the order of 1–3 nsec or less. The voltage shapes appearing at the second capacitor 119, the pulse transmission line 123 and the output of the second saturable inductor 125 of FIG. 8 are similar to the shapes shown in FIGS. 10(*b*), 10(*c*) and 10(*d*), respectively.

At some point, the temporal compression may be limited by the amount of charge a circuit element, such as a saturable inductor, can pass in a short time interval without permanently degrading the subsequent performance of the circuit element. This current limitation may be avoided by use of two or more compression networks in parallel, with a corresponding reduction in the maximum current associated with only one network.

The 1:12 transformer 115 in FIG. 8 may be repositioned to seat between the second capacitor 119 and the first saturable inductor 121, or between 121 and the pulse transmission line 123, or between 123 and the second saturable conductor 125, or between 125 and the second transformer 129. Alternatively, the voltage step-up (1:12) may be accomplished by the combined effect of two or more step-up transformers having lower individual voltage step-up ratios, for example 1:n and n:12 with $1<n<12$; each of these component transformers may then be positioned between 113 and 119, between 119 and 121, between 121 and 123, between 123 and 125, or between 125 and 127. The voltage step-up accomplished by the transformer 115 (or by a sequence of component transformers) need not be 1:12; this ratio is merely convenient for the application of the pulse forming network to acceleration of electron beams for certain applications. The remarks in this paragraph also apply to positioning of the transformer 141 (FIG. 9), which can also be decomposed into two or more component transformers and/or seated between 145 and 147, between 147 and 149, between 149 and 151, or between 151 and 153.

With reference to FIG. 8, the essential elements here are the second capacitor 119, the first and second saturable inductors 121 and 125, and the pulse transmission line 123, in the configuration shown. The thyratron 111, first capacitor 113 and first transformer 15 may be collectively replaced by a voltage pulse source that produces pulses with the appropriate current and voltage(e.g., 72 kamp and 150 kV) at the appropriate pulse duration and repetition rate(e.g., 1 μsec and 300 kHz). In a similar manner, the essential elements in the embodiment of FIG. 9 are the second and third capacitors 137 and 145, the first, second and third saturable inductors 139, 147 and 151, and the pulse transmission line 149, in that configuration.

Although the preferred embodiment of the subject invention has been shown and described herein, variation on and modification of the invention may be made without departing from the scope of the invention.

We claim:

1. A pulse-forming network for generating an initial voltage pulse of duration substantially one microsecond or greater and for reforming the pulse as a voltage pulse with a time duration of no more than 100 nanoseconds and pulse rise time and pulse fall time of at most 20 nanoseconds each and delivering tne pulse to a predetermined electrical load, the network comprising:

a voltage pulse source having an output terminal and capable of producing a sequence of one or more output pulses of current at least 20 kamps, voltage at least 20 kV and pulse duration substantially one μsec or greater;

a first capacitor having two terminals, with one terminal thereof being grounded and with a second terminal being operatively associated with the output terminal of the voltage pulse source;

a first saturable inductor having two terminals and with inductances satisfying $L^{(unsat)}/L^{(sat)} \geqq 100$, with a first terminal thereof operatively associated with the second terminal of the first capacitor;

a pulse transmission line having an associated impedance of substantially two ohms, with a first terminal thereof operatively associated with a second terminal of the first saturable inductor;

a second saturable inductor having two terminals and with inductances satisfying $L^{(unsat)}/L^{(sat)} \geqq 100$, with a first terminal thereof operatively associated with a second terminal of the pulse transmission line and with a second terminal thereof electrically connected to a load; and a grounded, electrically conducting tube substantially surrounding the electrical connection between the second saturable inductor and the load.

2. The network of claim 1, further including a voltage step-up transformer with step-up ratio at least 1:3, positioned between and connected to said second terminal of said first capacitor and said output terminal of said voltage pulse source.

3. The network of claim 1, further including a voltage step-up transformer with step-up ratio of at least 1:3, positioned between and connected to said second terminal of said first capacitor and said first terminal of said first saturable inductor.

4. The network of claim 1, further including a voltage step-up transformer with step-up ratio at least 1:3, positioned between and connected to said second terminal of said first saturable inductor and said first terminal of said pulse transmission line.

5. The network of claim 1, further including a voltage step-up transformer with step-up ratio of at least 1:3, positioned between and connected to said second terminal of said pulse transmission line and said first terminal of said second saturable inductor.

6. The network of claim 1, further including a voltage step-up transformer with step-up ratio of at least 1:3, positioned between and connected to said second terminal of said second saturable inductor and said electrical load.

7. A pulse-forming network for generating an initial voltage pulse of duration substantially one microsecond or greater and for reforming the pulse as a voltage pulse with a time duration of no more than 100 nanoseconds and pulse rise time and pulse fall time of at most 20 nanoseconds each and delivering the pulse to a predetermined electrical load, the network comprising:

a voltage pulse source having an output terminal and being capable of producing a sequence of one or more pulses with current at least 20 kamps, voltage at least 20 kV and pulse duration substantially one μsec or greater;

an inductor having two terminals, with a first terminal thereof being connected to the output terminal of tne voltage pulse source;

a first capacitor having two terminals, with one terminal thereof being grounded and a second terminal tnereof operatively associated with a second terminal of the inductor;

a first saturable inouctor having two terminals, with a first terminal thereof operatively associated with a second terminal of the first capacitor;

a second capacitor having two terminals, with a first terminal thereof being grounded and a second terminal operatively associated with a second terminal of the first saturable inductor;

a second saturable inductor having two terminals, with a first terminal thereof operatively associated with the second terminal of the second capacitor;

a pulse transmission line having two terminals and associated impedance of substantially two ohms, with a first terminal thereof operatively associated with a second terminal of the second saturable inductor;

a third saturable inductor having two terminals, with a first terminal thereof operatively associated with a second terminal of the pulse transmission line and with a second terminal thereof electrically connected to a load; and a grounded, electrically conducting tube substantially surrounding the electrical connection between the third saturable inductor and the load.

8. The network of claim 7, further including a voltage step-up transformer with step-up ratio of at least 1:3, positioned between and connected to said second terminal of said first capacitor and said first terminal of said first saturable inductor.

9. The network of claim 7, further including a voltage step-up transformer with step-up ratio of at least 1:3, positioned between and connected to said second terminal of said first saturable inductor and said second terminal of said second capacitor.

10. The network of claim 7, further including a voltage step-up transformer with step-up ratio of at least 1:3, positioned between and connected to said second terminal of said second capacitor and said first terminal of said second saturable inductor.

11. The network of claim 7, further including a voltage step-up transformer with step-up ratio of at least 1:3, positioned between and connected to said second terminal of said second saturable inductor and said first terminal of said pulse transmission line.

12. The network of claim 7, further including a voltage step-up transformer with step-up ratio of at least 1:3, positioned between and connected to said second terminal of said pulse transmission line and said first terminal of said third saturable inductor.

13. The network of claim 7, further including a voltage step-up transformer with step-up ratio of at least 1:3, positioned between and connected to said second terminal of said third saturable inductor and said electrical load.

* * * * *